US005870995A

United States Patent [19]

Stockner et al.

[11] Patent Number: 5,870,995

[45] Date of Patent: Feb. 16, 1999

[54] SPACE SAVING HIGH PRESSURE FLUID SUPPLY CLAMP FOR A FUEL INJECTOR

[75] Inventors: Alan R. Stockner, Metamora; Norval J. Wiemken, Dwight, both of Ill.

[73] Assignee: Caterpillar Inc., Peoria, Ill.

[21] Appl. No.: 872,333

[22] Filed: Jun. 10, 1997

[51] Int. Cl.[6] ..... F02M 57/02

[52] U.S. Cl. ..... 123/470; 123/456

[58] Field of Search ..... 123/446, 470, 123/472, 456

[56] References Cited

U.S. PATENT DOCUMENTS

| | | | |
|---|---|---|---|
| 4,205,789 | 6/1980 | Raufeisen | 239/533.3 |
| 4,901,700 | 2/1990 | Knight et al. | 123/470 |
| 5,325,834 | 7/1994 | Ballheimer et al. | 123/456 |
| 5,392,749 | 2/1995 | Stockner et al. | 123/470 |
| 5,499,612 | 3/1996 | Haughney et al. | 123/470 |

FOREIGN PATENT DOCUMENTS

| | | | |
|---|---|---|---|
| 94/20746 | 9/1994 | Germany | F02M 55/02 |

*Primary Examiner*—Thomas N. Moulis
*Attorney, Agent, or Firm*—Michael McNeil

[57] ABSTRACT

A hydraulically actuated fuel injection system includes an actuation fluid supply pipe having a flange. A hydraulically actuated fuel injector has a centerline, at least two different clamping surfaces and a side surface with an actuation fluid inlet. The clamping surfaces are positioned on opposite sides of the centerline. A clamp is attached to the flange of the actuation fluid supply pipe around the centerline of the injector while bearing against the at least two different clamping surfaces. The clamp allows for reliable sealing in a small space while minimizing internal distortion to injector components.

20 Claims, 5 Drawing Sheets

SPACE SAVING HIGH PRESSURE FLUID SUPPLY CLAMP FOR A FUEL INJECTOR

TECHNICAL FIELD

The present invention relates generally to clamps for connecting fuel injectors to a source of fluid, and more particularly to a space saving high pressure actuation fluid supply clamp for connecting hydraulically actuated fuel injectors to a source of high pressure fluid.

BACKGROUND ART

In most hydraulically actuated fuel injection systems, an actuation fluid, such as fuel or lubricating oil, is used as a hydraulic medium to actuate the individual injectors for each injection event. As two differently pressurized fluids (low pressure fuel and high pressure actuation fluid) must necessarily be provided to the fuel injectors in such a system, there must be adequate space in and around the engine for the various components necessary to supply the differently pressurized fluids which are themselves often different types of fluid (i.e. fuel and lubricating oil). In some engines, particularly relatively large diesel engines, it is often possible to incorporate separate actuation fluid and fuel fluid rails into the engine head. However, in many smaller type diesel engine applications, there is simply not enough space to incorporate both fluid rails into the engine head. Thus, in these cases, a separate external actuation fluid rail must often be mounted on the engine, and separate actuation fluid supply pipes from the rail must be attached to each individual injector. Space constraints are especially pronounce in those cases where a hydraulically actuated fuel injection system is retrofitted on a diesel type engine that originally used cam actuated fuel injectors. Still another complication in clamping fuel injectors to the actuation fluid supply pipes is the need to make the individual clamps accessible for maintenance purposes.

Apart from the space constraint and accessibility problems encountered in clamping hydraulically actuated fuel injectors to the actuation fluid supply pipes is the problem of how to avoid distortion to the injectors through the use of the clamping mechanism. Because the actuation fluid supply to each injector is at a relatively high pressure, relatively high clamping loads are necessary in order to insure against leakage of actuation fluid. In some cases, these relatively high clamping loads can cause internal distortion to the fuel injector, which can lead to seizing of the injector, even in those cases where space constraints are not particularly significant. Thus, even ignoring space constraints and accessibility, the actuation fluid supply clamp must provide an adequate clamping force to prevent against leakage, but must do so in a way that minimizes internal distortion in critical areas within the fuel injector.

The present invention is directed to overcoming one or more of the problems as set forth above.

DISCLOSURE OF THE INVENTION

A hydraulically actuated fuel injection system includes an actuation fluid supply pipe having a flange. A hydraulically actuated fuel injector has a centerline, at least two different clamping surfaces, and a side surface with an actuation fluid inlet. The clamping surfaces are positioned on opposite sides of the injector centerline. A clamp is attached to the flange of the actuation fluid supply pipe around the centerline of the hydraulically actuated fuel injector while bearing against at least two different clamping surfaces.

In another embodiment, a hydraulically actuated fuel injection system includes an actuation fluid supply pipe having a flange. A hydraulically actuated fuel injector has a centerline, at least two different clamping surfaces and a side surface with an actuation fluid inlet. The at least two different clamping surfaces are positioned on opposite sides of the injector's centerline and lie in a clamping plane that is substantially parallel to the centerline. A clamp is attached to the flange of the actuation fluid supply pipe around the centerline of the hydraulically actuated fuel injector while bearing against the at least two different clamping surfaces. The clamp includes a spacer bracket defining a pair of separate bolt holes, and a pair of bolts are received in respective bolt holes. The clamp produces a net force through the centerline of the hydraulically actuated fuel injector.

BEST MODE FOR CARRYING OUT THE INVENTION

Figure 1:
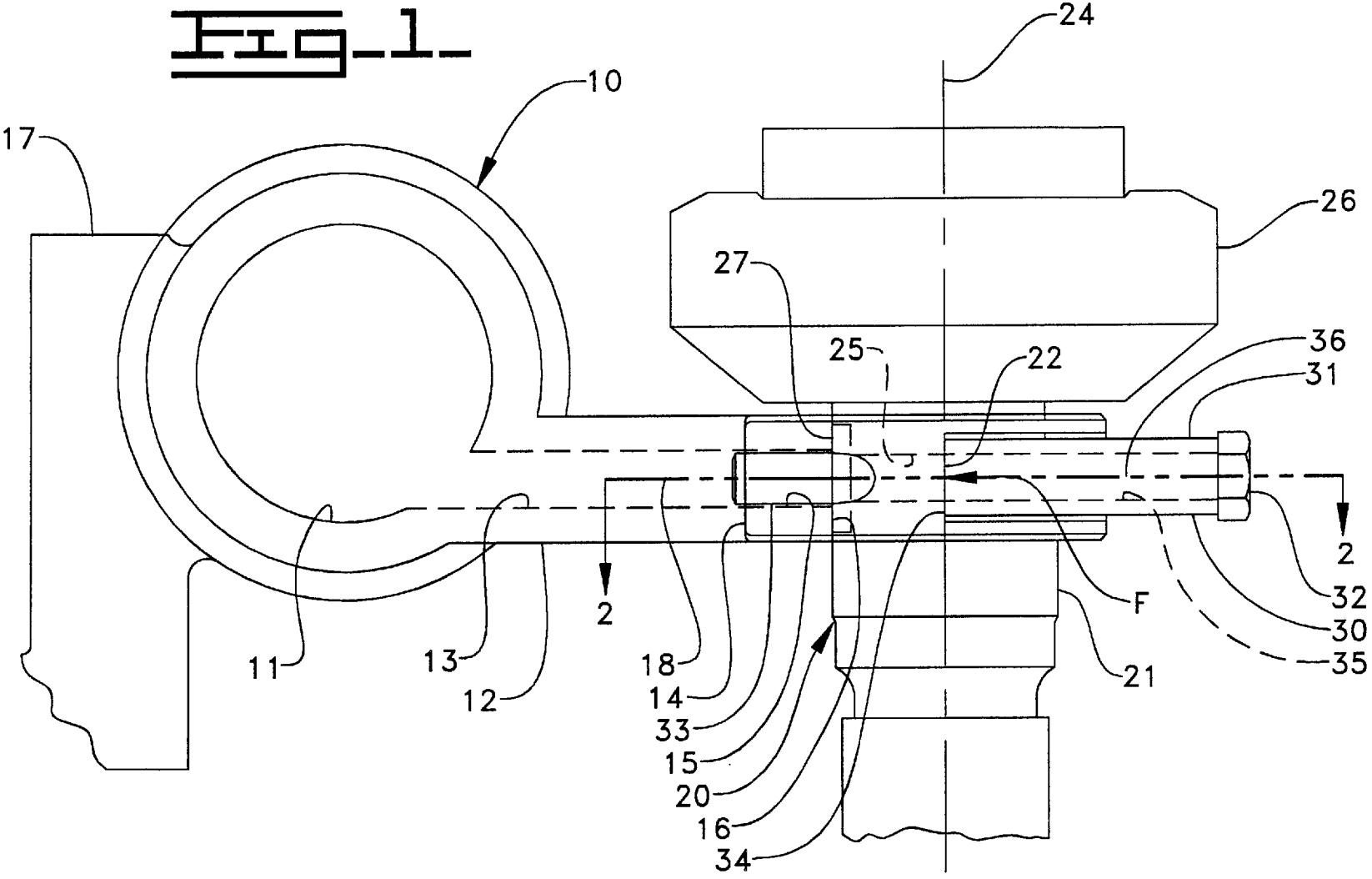
FIG. 1 is a side elevational view of a hydraulically actuated fuel injection system according to the present invention.
Figure 2:
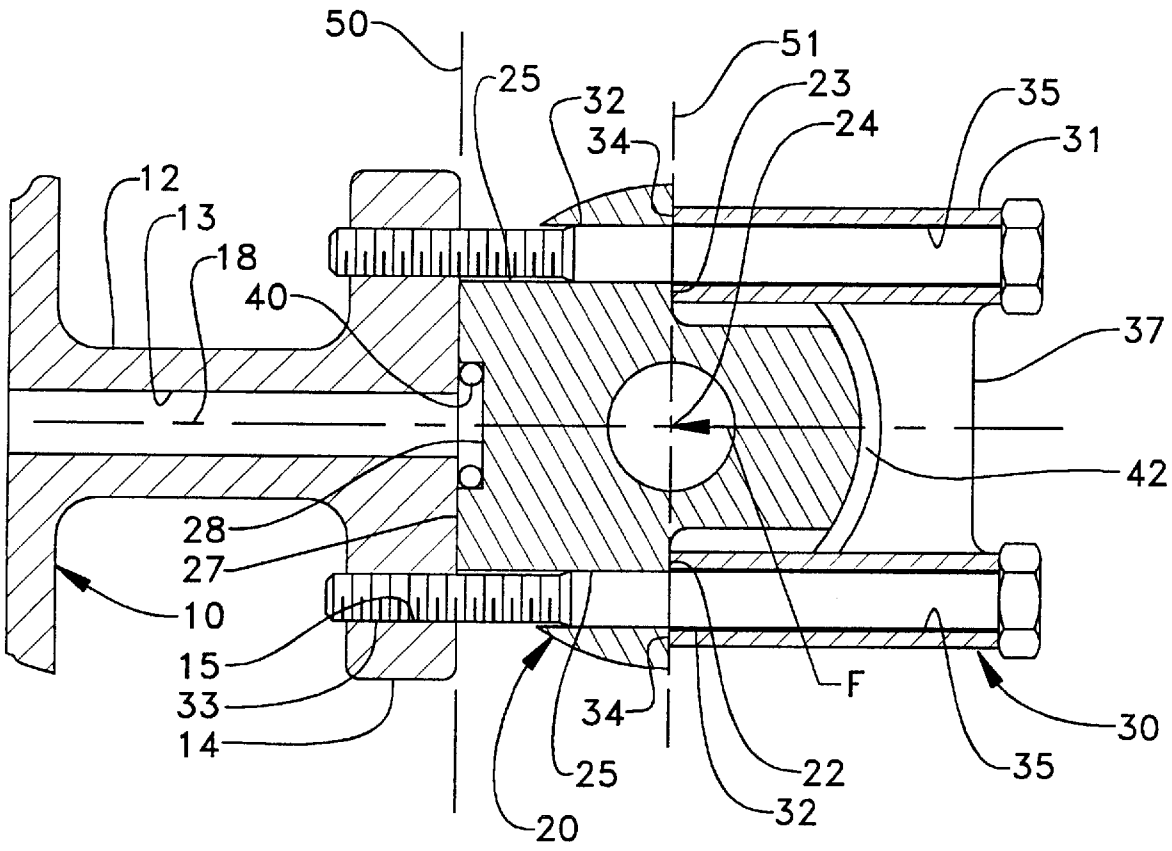
FIG. 2 is a sectioned top view of the hydraulically actuated fuel injection system of FIG. 1 as viewed along section lines 2—2.

Referring initially to FIGS. 1 and 2, a hydraulically actuated fuel injection system includes an actuation fluid rail 10 connected to a hydraulically actuated fuel injector 20 via a clamp 30. Actuation fluid rail 10 includes an inner cavity 11 holding an actuation fluid, such as lubricating oil, at a relatively high pressure. Actuation fluid rail 10 is attached to an engine via mounts 17 utilizing conventional fasteners, such as bolts. In the preferred embodiment, rail 10 is a common rail supplying actuation fluid to a plurality of hydraulically actuated fuel injectors 20 via a plurality of spaced apart actuation fluid supply pipes 12, only one of which is shown in FIGS. 1 and 2. Actuation fluid supply pipe 12 includes an inner supply passage 13 that opens to the actuation fluid inlet 28 of fuel injector 20. Actuation fluid supply pipe 12 includes a flange 14 having a flat end surface and a pair of threaded bolt holes 15 on either side of supply passage 13.

Figure 3:
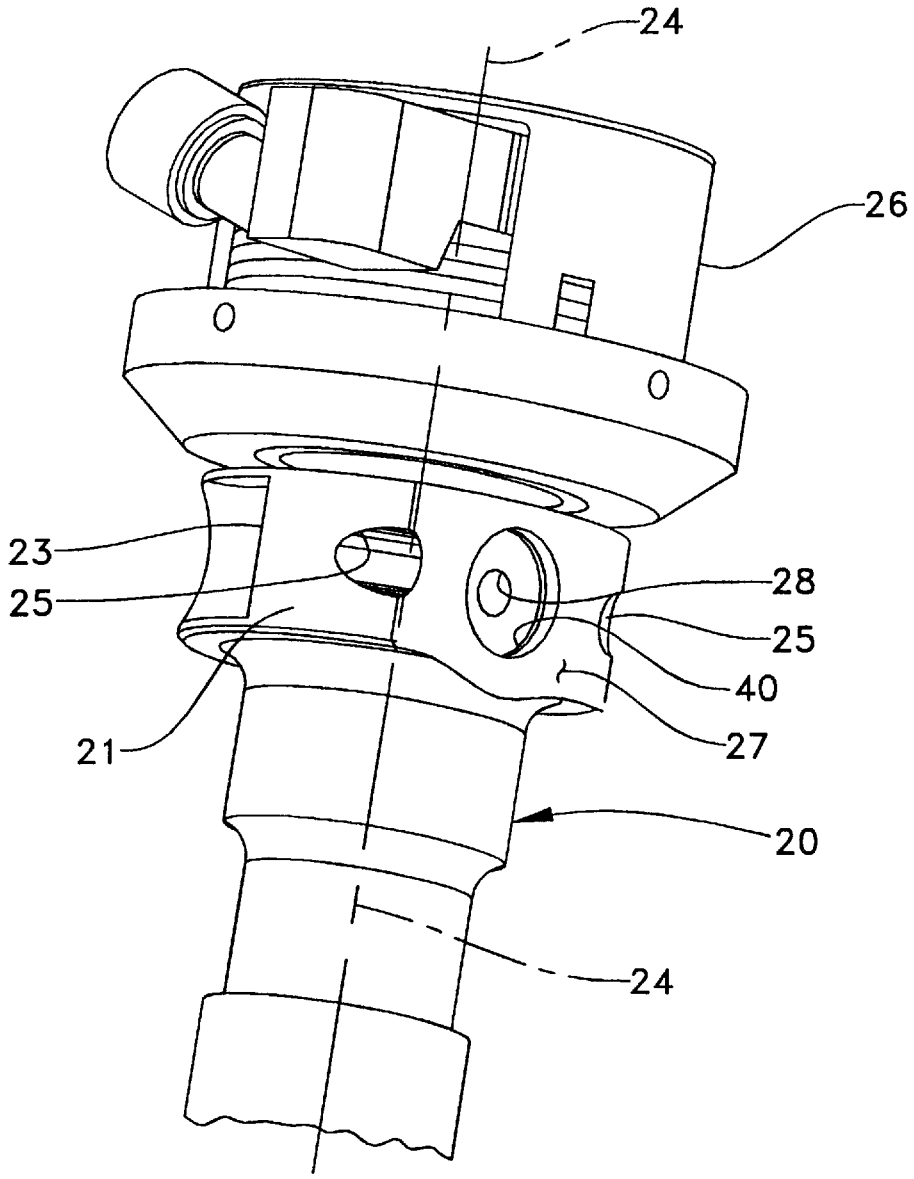
FIG. 3 is an isometric view of a hydraulically actuated fuel injector with a modified outer surface according to one aspect of the present invention.
Figure 4:
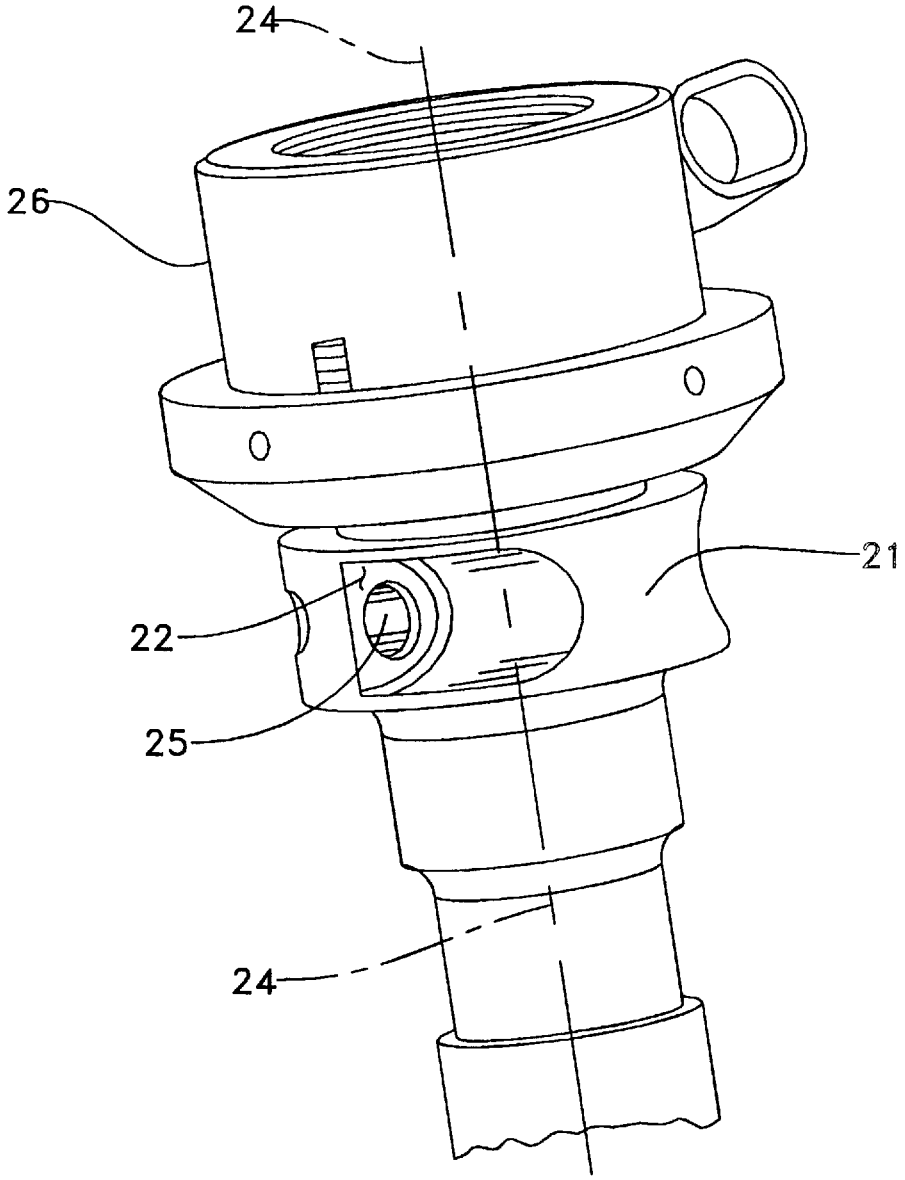
FIG. 4 is an isometric view of the fuel injector of FIG. 3 from a different direction.

Hydraulically actuated fuel injector 20 includes a centerline 24, a first clamping surface 22, a second clamping surface 23 and a side surface 21. Clamping surfaces 22 and 23 are positioned on opposite sides of centerline 24. Preferably, clamping surfaces 22 and 23 lie in a clamping plane 51 that is substantially parallel to centerline 24. Even more preferably, centerline 24 lies substantially in clamping plane 51. Referring in addition to FIGS. 3 and 4, side surface 21 of fuel injector 20 includes a flat area 27 that defines an inlet plane 50 and surrounds actuation fluid inlet 28. Preferably, inlet plane 50 is substantially parallel to clamping plane 51, as shown in FIG. 2. Fuel injector 20 also includes a pair of parallel oriented injector bolt holes 25 that open on one end through respective clamping surfaces 22 and 23, and on their other ends adjacent flat surface 27.

Clamp 30 includes a spacer bracket 31 and a pair of conventional fasteners, such as bolts 32. Bolts 32 are received in a pair of separated bolt holes 35 that are preferably parallel to one another and oriented substantially perpendicular to centerline 24. The threaded ends 33 of bolts 32 match the internal threads of threaded bores 15 in flange 14. It should be noted that spacer bracket 31 bears against clamping surfaces 22 and 23 but is separated from fuel injector 20 at area 42. By matching the torques on bolts 32, the net force F produced by clamp 30 can be directed along a line 18 that intersects centerline 24, is perpendicular to centerline 24 and points substantially through the center of actuation fluid inlet 28 and supply passage 13 of actuation fluid supply pipe 12. Thus, clamp 30 holds flat area 27 against the flat end of flange 14 while aligning supply passage 13 with actuation fluid inlet 28. Leakage of high pressure actuation fluid is prevented by including a conventional D-ring 40 in actuation fluid inlet 28.

Figure 5:
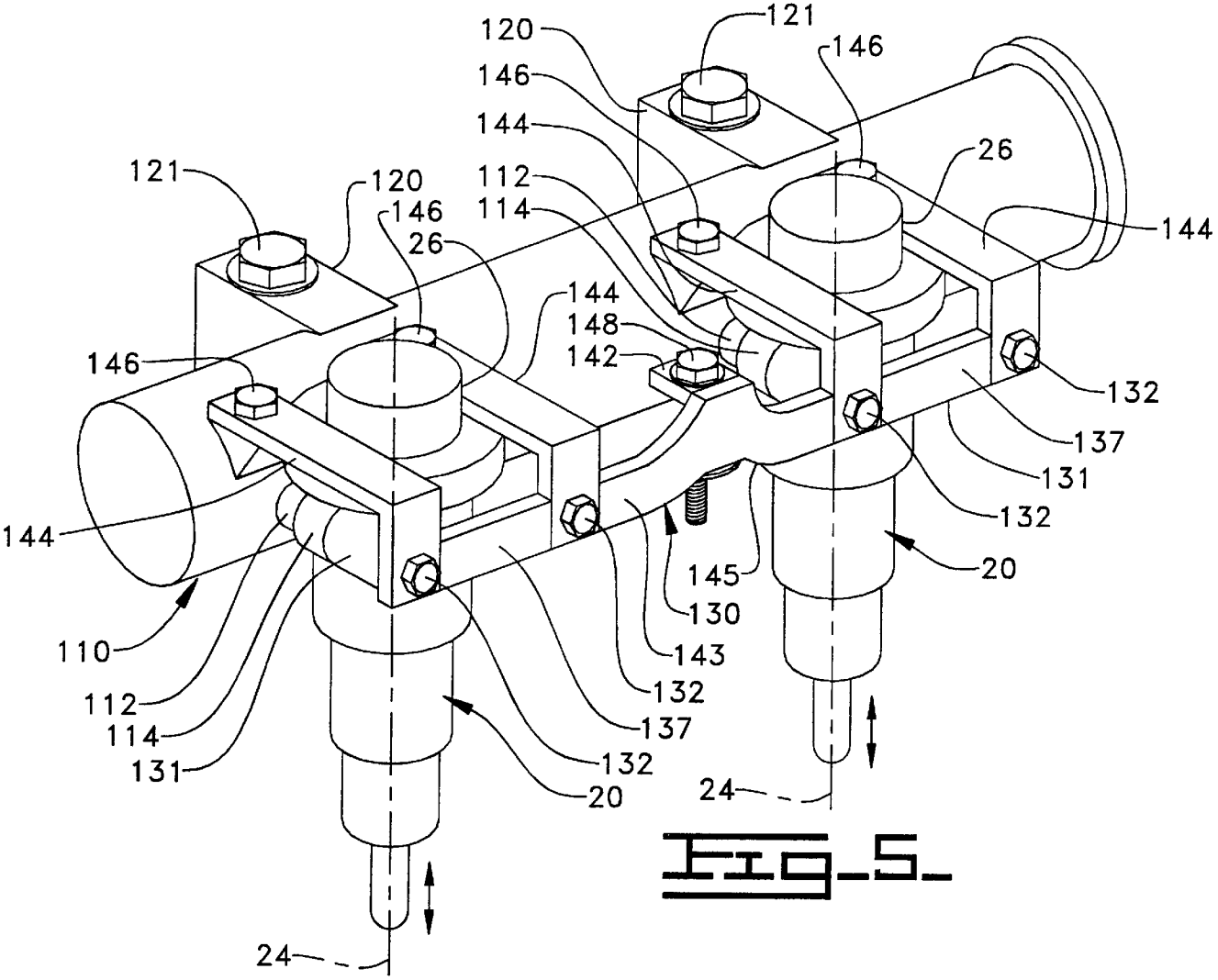
FIG. 5 is an isometric view of a hydraulically actuated fuel injection system according to another embodiment of the present invention.

Referring now to FIG. 5, an additional embodiment of the present invention incorporates a clamp according to the present invention into a noise reducing bracket 130 such that each noise reducing bracket includes a pair of clamps 131 according to the present invention. In this case, a common actuation fluid rail 110 includes a pair of actuation fluid supply pipes 112 having flanges 114 that are shaped substantially identical to the earlier embodiment. In addition, actuation fluid rail 110 is attached to an engine via mounts 120 and conventional fasteners, such as bolts 121. Hydraulically actuated fuel injector 20 is substantially identical to the injectors described in regard to the first embodiment.

Noise reducing bracket 130 includes a support 142 that is attached to an engine via a conventional fastener, such as bolt 148. Noise reducing bracket 130 also includes a pair of clamps 131 having a structure substantially similar to that described in the first embodiment that are separated from support 142 by a pair of arms 143 and 145. As in the previous embodiment, clamps 131 are each clamped to a respective fuel injector 30 via a pair of bolts 132 that are received in threaded openings in supply pipe flange 114 of supply pipes 112. In this way, a portion of the fuel injector body is surrounded and held in a substantially rigid position with respect to noise reducing bracket 130. As in the previous embodiment, the clamp load is preferably applied through the centerline 24 of fuel injector 20 in order to avoid distortion in critical internal areas of the injector. As in the previous embodiment, clamps 131 include a spacer portion 137 to help insure that the heads of the bolts are easily accessible once the complete system is mated to an engine.

In order to further rigidify and couple the mass of fuel injectors 20 with actuation fluid rail 110, noise reducing bracket 130 includes four over the top extensions 144. Extensions 144 are rigidly attached to fluid rail 110 at mounts attached to the side of the rail via conventional bolts 146. Thus, noise reducing bracket 130 serves as both the means by which the actuation fluid inlet of injectors 20 are connected to actuation fluid rail 110, and also the means by which the mass of fluid rail 110 is coupled to that of injectors 20.

Industrial Applicability

The present invention accomplishes a minimized distortion clamping for the high pressure actuation fluid by coordinating various planes and lines associated with the actuation fluid supply pipe, the injector and the clamp itself. In particular, by appropriately machining the outer surface of the injector, the clamping load can be applied on either side of centerline 24 in a plane that contains the centerline, and the net force produced by the clamp can be directed perpendicularly through the centerline. Furthermore, by appropriately positioning the actuation fluid inlet and the supply passage from the actuation fluid supply pipe, this force can also be directed through the center opening of these fluid passageways. Finally, by making the contact surface between the injector and the flange of actuation fluid supply pipe 12 flat and by orienting this plane substantially parallel to the clamping plane, potential distortion to the internal components of the injector are further minimized.

By utilizing a spacer bracket, the ends of bolts 32 can be exposed beyond the upper portion 26 of the fuel injectors for easy access during maintenance to a particular engine. However, in some cases it may be possible to eliminate spacer bracket 31 and rely simply upon a pair of bolts to attach injector 20 to the flange 14 of the actuation fluid supply pipe when the particular mounting orientation of the injectors and access to the bolt heads is otherwise readily available. In addition, the direction of the bolts 32 could be reversed and the spacer bracket be made to be threaded instead of threading bores in the flange for the supply pipe. Nuts could also be used with the bolts to avoid having to thread any of the bores. In some other cases it might also be possible to reverse the direction of bolts 32, eliminate the spacer bracket 31 and make the injector bores 25 themselves threaded in order to facilitate attachment of injector 20 to the flange 14 of the actuation fluid supply pipe 12.

It should be understood that the above description is intended for illustrative purposes only, and is not intended to limit the scope of the present invention in any way. Those skilled in the art will appreciate that the present invention, especially the shape of spacer 31 and the particular fasteners chosen, can come in a wide variety of shapes and sizes and still accomplish the low distortion and space saving goals of the present invention. In addition, those skilled in the art will appreciate that the clamp according to the present invention could be an off center toggle clamp in order to provide a quick release between the injectors and the actuation fluid supply pipe. In such a case, a predetermined clamping load could be provided by properly sizing the toggle clamp and by positioning one on each side of the injector in place of the bolts shown in the preferred embodiment. In any event, the scope of the present invention should be determined in terms of the claims set forth below.

We claim:

1. A hydraulically actuated fuel injection system comprising:

an actuation fluid supply pipe having a flange;

a hydraulically actuated fuel injector having a centerline, at least two different clamping surfaces and a side surface with an actuation fluid inlet, and said at least two different clamping surfaces being positioned on opposite sides of said centerline; and a clamp being attached to said flange of said actuation fluid supply pipe around said centerline of said hydraulically actuated fuel injector while bearing against said at least two different clamping surfaces.

2. The hydraulically actuated fuel injection system of claim 1 wherein said at least two different clamping surfaces lie in a clamping plane that is substantially parallel to said centerline.

3. The hydraulically actuated fuel injection system of claim 2 wherein said centerline lies substantially in said clamping plane.

4. The hydraulically actuated fuel injection system of claim 2 wherein said side surface includes a flat area that defines an inlet plane and surrounds said actuation fluid inlet; and said inlet plane being substantially parallel to said clamping plane.

5. The hydraulically actuated fuel injection system of claim 4 wherein said centerline lies substantially in said clamping plane.

6. The hydraulically actuated fuel injection system of claim 1 wherein said clamp includes a spacer bracket defining a pair of separated bolt holes, and a pair of bolts received in different ones of said bolt holes.

7. The hydraulically actuated fuel injection system of claim 6 wherein said bolt holes are parallel to one another.

8. The hydraulically actuated fuel injection system of claim 7 wherein said bolt holes are substantially perpendicular to said centerline.

9. The hydraulically actuated fuel injection system of claim 6 wherein each of said hydraulically actuated fuel injector includes a pair of injector bolt holes that receive different ones of said pair of bolts.

10. The hydraulically actuated fuel injection system of claim 1 wherein said clamp produces a net force through said centerline of said hydraulically actuated fuel injector.

11. The hydraulically actuated fuel injection system of claim 10 wherein said net force points substantially through a center of said actuation fluid inlet.

12. The hydraulically actuated fuel injection system of claim 11 wherein said net force points in a direction substantially perpendicular to said centerline.

13. The hydraulically actuated fuel injection system of claim 10 wherein said centerline lies substantially in said clamping plane.

14. A hydraulically actuated fuel injection system comprising:

an actuation fluid supply pipe having a flange;

a hydraulically actuated fuel injector having a centerline, at least two different clamping surfaces and a side surface with an actuation fluid inlet, and said at least two different clamping surfaces being positioned on opposite sides of said centerline and lie in a clamping plane that is substantially parallel to said centerline;

a clamp being attached to said flange of said actuation fluid supply pipe around said centerline of said hydraulically actuated fuel injector while bearing against said at least two different clamping surfaces, and said clamp including a spacer bracket defining a pair of separated bolt holes, and a pair of bolts received in different ones of said bolt holes; and said clamp produces a net force through said centerline of said hydraulically actuated fuel injector.

15. The hydraulically actuated fuel injection system of claim 14 wherein said centerline lies in said clamping plane.

16. The hydraulically actuated fuel injection system of claim 15 wherein said side surface includes a flat area defining an inlet plane and surrounding said actuation fluid inlet; and said inlet plane being substantially parallel to said clamping plane.

17. The hydraulically actuated fuel injection system of claim 16 wherein said bolt holes are parallel to one another and substantially perpendicular to said centerline.

18. The hydraulically actuated fuel injection system of claim 17 wherein said hydraulically actuated fuel injector includes a pair of injector bolt holes that receive different ones of said pair of bolts.

19. The hydraulically actuated fuel injection system of claim 18 wherein said net force points in a direction substantially perpendicular to said centerline.

20. The hydraulically actuated fuel injection system of claim 19 wherein said centerline lies substantially in said clamping plane.

* * * * *